350-407 SR
9/6/83 XR 4,402,510

United States Patent [19]

Yokoi

[11] 4,402,510

[45] Sep. 6, 1983

[54] PUZZLE TOY

[75] Inventor: Gunpei Yokoi, Kyoto, Japan

[73] Assignee: Nintendo Co., Ltd., Japan

[21] Appl. No.: 348,506

[22] Filed: Feb. 12, 1982

[30] Foreign Application Priority Data

Mar. 10, 1981 [JP] Japan ..... 56-33789[U]
Mar. 13, 1981 [JP] Japan ..... 56-36818
Jul. 1, 1981 [JP] Japan ..... 56-103017

[51] Int. Cl.[3] ..... A63F 9/08

[52] U.S. Cl. ..... 273/153 S; 273/157 A; 350/407

[58] Field of Search ..... 273/153 S, 282, 157 A; 350/394, 395, 407

[56] References Cited

U.S. PATENT DOCUMENTS 2,617,329 11/1952 Dreyer ..... 350/407 X
2,786,292 3/1957 Graves ..... 350/407 X
3,588,115 6/1971 Nichols ..... 273/157 R X
3,778,063 12/1973 Strand ..... 273/157 A UX

*Primary Examiner*—Anton O. Oechsle
*Attorney, Agent, or Firm*—C. Cornell Remsen, Jr.; Jordan B. Bierman; Linda Bierman

[57] ABSTRACT

A puzzle toy is provided in which a game may be played to achieve a desired combination of colors by shifting several puzzle elements arranged checkerwise in the lengthwise and the breadthwise directions. The puzzle toy includes a plurality of polarizing plates fixed to a case and individual polarizing plates fixed to the individual puzzle elements. Color indication of the puzzle elements is varied with the change of the relative relationship of the polarizing axis of the individual polarizing plates to that of the first polarizing plates, due to the transparency indication action and the polarizing color indication action which result from the principle of double refraction polarization.

8 Claims, 34 Drawing Figures

PUZZLE TOY

BACKGROUND OF THE INVENTION

1. Field of the Invention

This invention relates to a puzzle toy with which a game is played for achieving the desired puzzle indication of the combination of colors, characters, symbols or the like by shifting a plurality of puzzle elements arranged checkerwise in a first direction (lengthwise, for example) and a second direction (breadthwise, for example).

2. Prior Art

A puzzle toy is already known with 16 or 15 puzzle elements, each having on its surface the specific color, pattern, figure, character, symbol or the like, the elements being movable lengthwise and breadthwise and arranged checkerwise; the puzzle is solved when the desired indication of configuration, landscape or the like is obtained by shifting puzzle elements properly, or when the puzzle elements make a specific arrangement, such as 1, 2, 3 . . . 15, and A, B, C . . . N, O.

In the above known puzzle toy, each puzzle element has its own symbol, color or the like and therefore, it is easy to presuppose or to keep in mind the order of shifting puzzle elements for solving the puzzle.

SUMMARY OF THE INVENTION

An object of the present invention is to make the puzzle indication (color, for example) of each puzzle element variable according to the location of the puzzle element; more particularly, the color indication of each puzzle element is varied with the shifting of the puzzle element, thereby making it difficult to presuppose and to keep in mind the order of shifting puzzle elements for solving the puzzle, and accordingly making the puzzle game more interesting and complicated.

According to the present invention, the puzzle toy comprises several first polarizing plates fixed to a case and second polarizing plates which are fixed to individual puzzle elements, and which make the corresponding polarizing plates change according to the shifting of puzzle elements. As a result of the double refraction polarization principle between the two sets of polarizing plates, the indication by each puzzle element provides either a transparency indication or a polarized color indication and as a result, color indication by a puzzle element is varied in conjunction with the first polarizing plates with the shifting of the puzzle element.

BRIEF DESCRIPTION OF THE DRAWINGS

The nature and advantage of the present invention will be understood more clearly from the following description made with reference to the accompanying drawings, in which:

FIG. 1 to FIG. 6 illustrate an example of the method of shifting puzzle elements in a puzzle toy, in which:

FIG. 1 is a schematic view showing the positional relation between the puzzle indication surface and the additional indication surface;

FIG. 2 is a top plan view, partially in cross-section, of a form of puzzle;

FIG. 3 is a longitudinal section along the line 3—3 of FIG. 2;

FIG. 4 is a longitudinal section along the line 4—4 of FIG. 2;

FIG. 5 is a schematic view similar to FIG. 1 showing the movement of puzzle elements;

FIG. 6 is a schematic view showing the movement of sliding elements of FIG. 1;

FIG. 7 to FIG. 10 show the change of color indication based on the double refraction polarization principle, in which:

FIG. 7 is a perspective view showing individual polarizing elements;

FIG. 8 is a perspective view showing first polarizing plates;

FIG. 9 is a schematic view showing the positional relationship between both the polarizing plate and the polarizing elements;

FIG. 10 is a schematic view illustrating the color change based on the double refraction polarization principle utilizing the elements of the present invention;

DETAILED DESCRIPTION OF THE INVENTION

Figure 2:
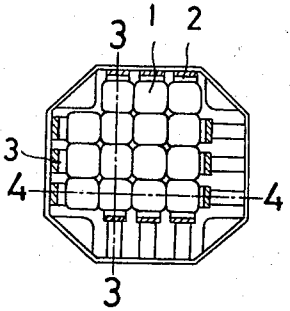
Figure 6:
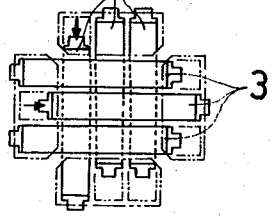
Figure 1:
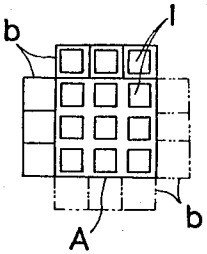
Figure 5:
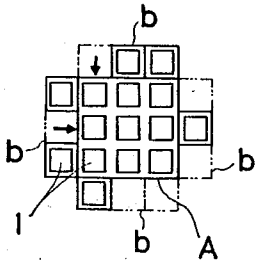
Figure 3:
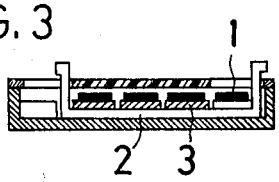
Figure 7:
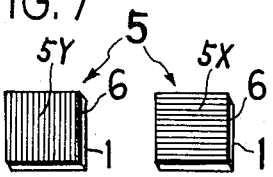
Figure 4:
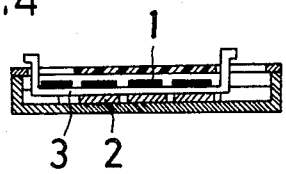

Referring to FIGS. 1–6, illustrating the principle of the present invention, several (9 pieces, for example) individual puzzle elements 1 are arranged checkerwise in plural rows (rows of three in each direction, for example) on a puzzle indication surface A, alongside of which an additional indication surface b of the area substantially the same as the surface area of an individual puzzle element can be formed. This additional indication surface b could exist alongside the four sides of the puzzle indication surface A but for effective use of the additional indication surface b, it is advisable to provide the additional indication surface b only on one side of the first direction (lengthwise direction) of the puzzle indication surface A and only on one side of the second direction (in the direction of breadth) of the puzzle indication surface A. Therefore, the number of additional indication surfaces b available is one half (6 pieces) of the number of positions at which additional indication surfaces could exist (12 pieces).

In order to make puzzle elements 1 slidable both in the first direction and in the second direction, a plurality of first sliding plates 2 which are slidable in the first direction, and a plurality of second sliding plates 3 which are slidable in the second direction are provided. By properly selecting certain of the sliding plates 2 and 3 and by shifting these selected plates toward the side of an additional indication surface b in the direction of the arrows shown in FIGS. 5 and 6, one of the puzzle elements 1 will be shifted in a first direction away from the puzzle indication surface and another will be shifted away in a second direction; all to obtain the desired puzzle indication.

Referring to FIG. 7 to FIG. 10, elements of a puzzle toy according to the present invention are described below.

Figure 8:
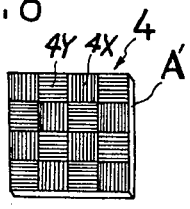
Figure 9:
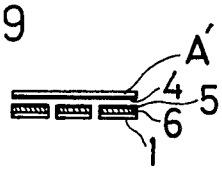

A first polarizing plate 4 and second individual polarizing plates 5, the latter being substantially the same as a puzzle element 1 in surface area and shape, are arranged in such a fashion that they are classified into two groups of two different kinds, 5X, 5Y and 4X, 4Y, each having polarizing axes at right angles to one another. The polarizing plate 4 having the same number as the puzzle elements 1 positioned on the puzzle indicating surface A' (16 pieces, for example) is bonded to the underside of the surface which is a transparent plastic plate, after selecting the direction of polarizing axis, so that two groups 4X, 4Y are arranged properly (checkered arrangement as shown by FIG. 8, for example). Each polarizing plate 4 is made to correspond to an individual puzzle element 1 of the puzzle indication surface A.

The polarizing plates 5 are bonded to individual puzzle elements 1 in such a fashion that their polarizing axes are classified into two groups 5X, 5Y which are the same in the direction of polarizing axis as either the polarizing axis of 4X or 4Y of the first polarizing plate 4 by properly selecting the direction of the polarizing axis.

Figure 10:
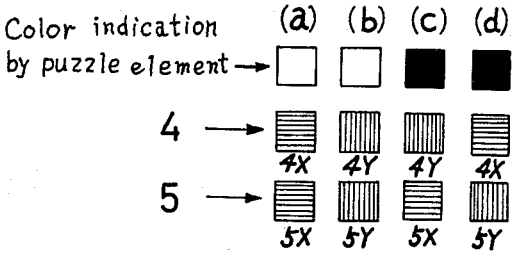

On the basis of the double refraction polarization principle between the first polarizing plate 4 and the polarizing plate elements 5 which are positioned below the former, in the case where polarizing axes of both polarizing plates 4,5 are in parallel with each other, transparency indication will result as shown by FIG. 10(*a*) and (*b*). On the other hand, in the case where polarizing axes of both polarizing plates cross each other at right angles, polarized color indication will result as shown in FIG. 10(*c*) and (*d*). Thus, color indication by puzzle elements 1 is made either transparency indication (a) (b) or polarized color indication (c) (d) according to four correlations between polarizing axes of the first and second polarizing plates as shown by FIG. 10(*a*), (*b*), (*c*) and (*d*).

By making the first polarizing plates 4 colored, polarized color indication can be made red, green, etc. as desired.

Referring to the transparency indication, in order to make clear the color indication by puzzle elements a reflecting plate 6 is disposed below both polarizing plates 4,5. In the preferred embodiment, the reflecting plate 6 is bonded to the underside of the individual polarizing plates 5 in order to make the presence of the puzzle elements 1 more clear, and to indicate the puzzle elements 1 which are positioned on the additional indication surface b are the color of the reflecting plate 6. Also, the first polarizing plate is made of a color polarizing filter so that the polarized color indication is made the specified color indication (red, blue, yellow, purple, etc.). In order to make a clear distinction between the transparency indication and the polarized color indication, aluminum reflecting plates are used so that transparency indication is made either of a white or silver color.

Figure 11:
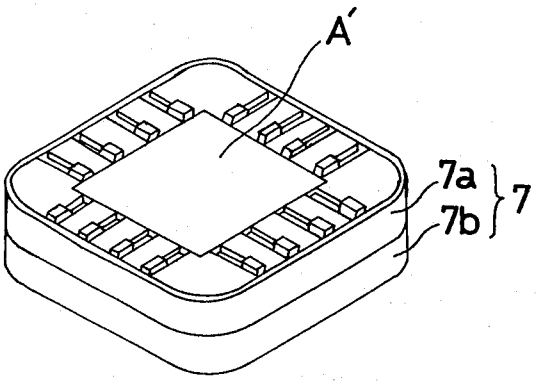
FIG. 11 is an overall perspective view of the puzzle toy embodying the present invention.
Figure 12:
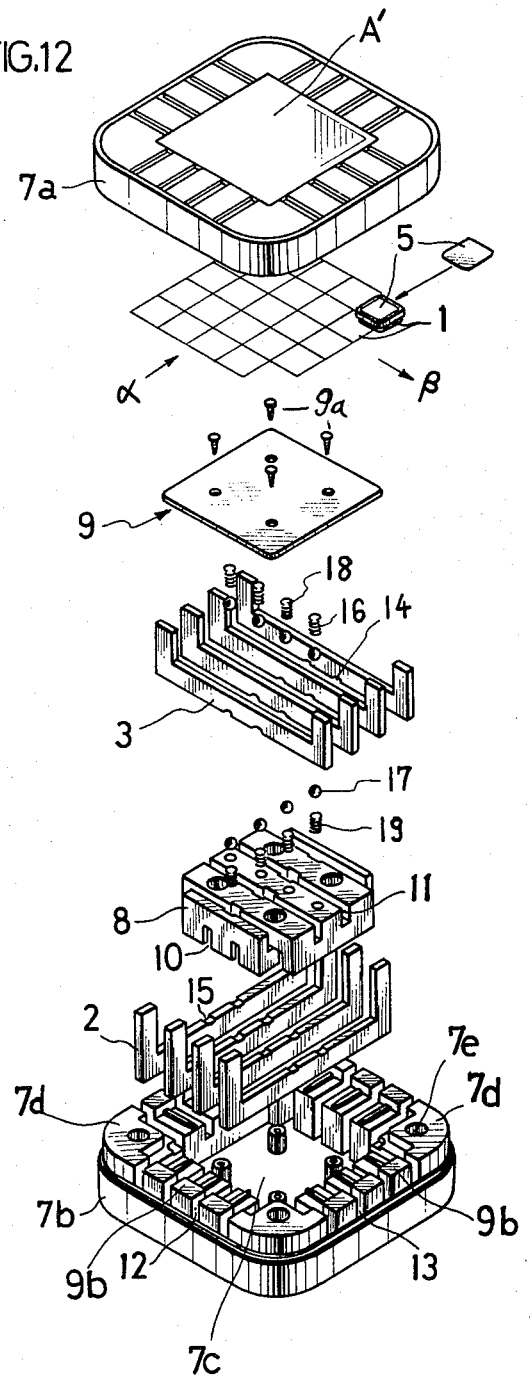
FIG. 12 is an exploded perspective view of the puzzle toy shown in FIG. 11 as it is disassembled.

Descriptions are made below of a practical example of the puzzle toy according to the present invention, with particular reference to FIGS. 11–13.

A casing 7 comprises an upper casing 7*a* with the previously indicated transparent indication surface A' which corresponds to the puzzle indication surface A of FIGS. 1–6 and a bottom supporting casing 7*b*.

Within and supported by bottom casing 7*b* is a molded support 7*c*, hollowed at its center with an integral upstanding peripheral structure. The latter is provided with corner posts 7*d* through which are provided openings into which screws (not shown) are used to attach the bottom casing section 7*b* to the top 7*a*. At suitable intervals about the peripheral structure are provided slots 12 and 13 adapted to receive the sliding plates 2 and 3 in a manner hereinafter described.

Transverse slides 2, in this case four, are positioned in the respective transverse grooves 12, and upon the center two slides is mounted a guiding member 8 having a pair of parallel grooves 10 on its underside. The said two grooves 10 and the transverse sides of guiding member 8 serve to restrictively guide the transverse movement of slides 2.

On its upper side guiding member 8 is provided with a pair of parallel grooves 11 which become aligned with the two center longitudinal slots 13. Guiding member 8, grooves 11 and slots 13 are adapted to receive and restrictively guide the longitudinal movement of slides 3.

The height of molded support 7*c* is such that the transverse portions of slides 2, the guiding member 8 and the longitudinal portions of slides 3 all fit within said support, all of these elements in turn being held in place by a receiving plate 9 attached to support 7*c* by means of screws 9*a* engaging threaded posts 9*b* integral with the support.

Receiving plate 9 together with the top outer edge of molded support 7*c*, serves as the base for the individual puzzle elements 1 which are movable simultaneously in a row in the lengthwise direction $\beta$ (first direction) and in the lateral direction $\alpha$ (second direction) with the movement of the first sliding plates 2 and the second sliding plates 3 and are arranged checkerwise at the puzzle indication surface A and also at the additional indication surface b. In the example shown in FIG. 12, the number of second sliding plates 3 is four (the same as the number of rows of puzzle elements arranged checkerwise in lateral direction or second direction) and the number of first sliding plates 2 is four (the same as the number of rows of puzzle elements arranged checkerwise in lengthwise direction or first direction) and the number of puzzle elements is sixteen on the puzzle indication surface A but eight at the additional indication surface b. Bonded to the back of the indication surface A' of upper case 7*a*, at such a position as opposing puzzle elements 1 arranged checkerwise at the puzzle indication surface are first polarizing plates 4X, 4Y arranged checkerwise, for example, as shown in FIGS. 8 and 13. Each puzzle element 1 is bonded with a polarizing plate 5 and a reflecting plate 6, the latter underlying the former. In bonding a second polarizing plate 5 to a puzzle element 1, the direction of polarizing axis is selected so that two groups 5X, 5Y have the polarizing axes which are the same in direction as the polarizing axes 4X, 4Y of the polarizing plates 4.

Both sliding plates 2, 3 have notches 14, 15, balls 16, 17 and push springs 18, 19 respectively, so that they remain at the selected position when they are not moved by a player.

In the above embodiment, the puzzle indication is changed by moving puzzle elements through movement of sliding plates 2, 3, but the change of puzzle indication is explained below in detail, with reference to FIG. 14–FIG. 20.

Figure 13:
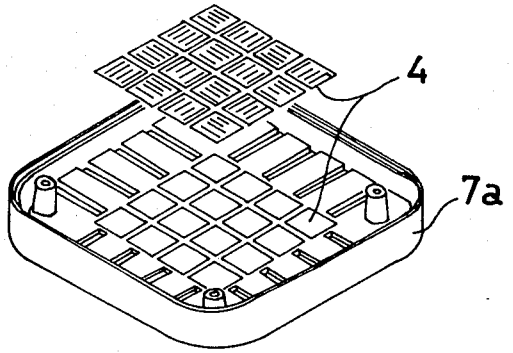
FIG. 13 is a perspective view of the upper case as it is viewed from the bottom side.

As shown in FIG. 13 and FIG. 14(*a*), polarizing plates 4 are arranged in such a fashion that adjoining plates differ from each other in the direction of the polarizing axis. Puzzle elements 1 are so arranged that the direction of the polarizing axis of individual plates 5 on sixteen puzzle elements on the puzzle indication surface A is different from that of the polarizing plates of the eight puzzle elements on the additional indication surface b, for example, regarding polarizing plates 5, those having the polarizing axes in lateral direction 5X and in lengthwise direction 5Y number sixteen and eight respectively; regarding polarizing plates 4, those having the polarizing axis in lateral direction 4X and in the lengthwise direction 4Y number eight each.

FIG. 14(*b*) shows the mutual relationship in the direction of the polarizing axis between polarizing plates 4X,4Y and polarizing plates 5X,5Y in the above-mentioned arrangement. FIG. 14(*c*) shows the color indication based on the polarizing action by both polarizing plates 4, 5.

Figure 14A:
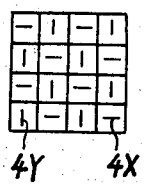
FIGS. 14*a*–14*c* are schematic views showing an example of the puzzle indications of the puzzle toy according to the present invention as it may be prepared for use, FIG. 14(*a*) showing an arrangement of the first polarizing plate, FIG. 14(*b*) showing an arrangement of the second polarizing elements and FIG. 14(*c*) showing the color indication by a combination of the two.
Figure 14B:
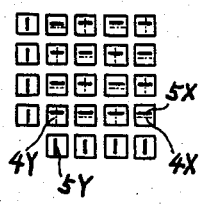
Figure 14C:
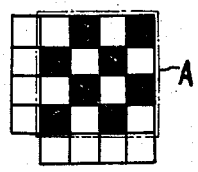
Figure 15A:
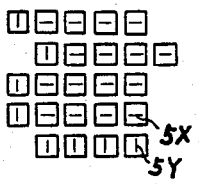
FIGS. 15*a*–*c* and FIGS. 16*a*–*c* show respectively the change of color with the shifting of puzzle elements.
Figure 15B:
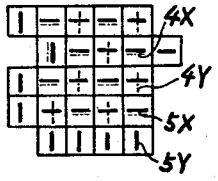
Figure 15C:
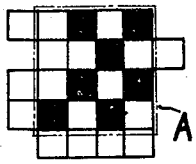
Figure 16A:
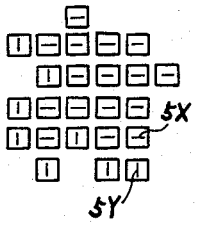
Figure 16B:
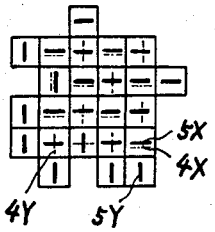
Figure 16C:
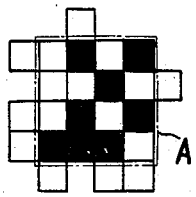

FIGS. 15*a–c* and FIGS. 16*a–c* show the change in mutual relationship of the polarizing axes between both polarizing plates and the change in color indication according to shifting of puzzle elements, as in the case of FIGS. 14*a–c*.

Figure 17A:
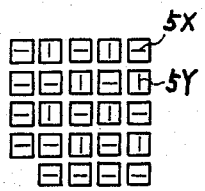
FIGS. 17*a*–*c* to FIGS. 20*a*–*c* are schematic views showing various puzzle indications for different puzzle solutions.
Figure 17B:
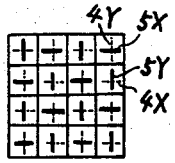
Figure 17C:
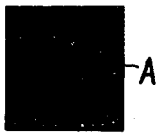
Figures 18A, 18B, 18C:
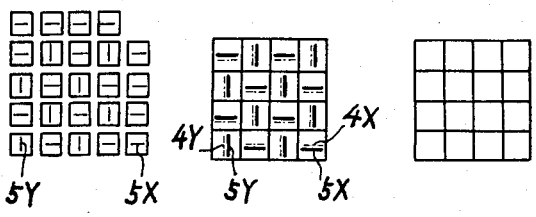
Figures 19A, 19B, 19C:
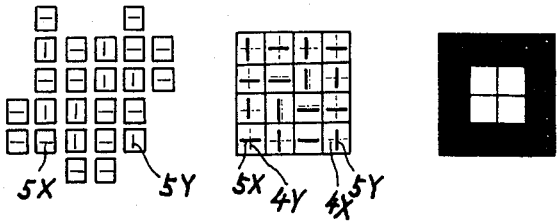
Figures 20A, 20B, 20C:
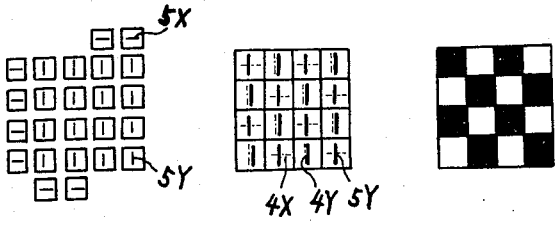

FIGS. 17*a–c*–FIGS. 20*a–c* are schematic views, each showing the completion of a puzzle indication. The configuration at the completion of puzzle indication can be selected as a player likes. For example, FIGS. 17*a–c* show the case where the puzzle indication surface A indicates polarizing color in its entirety and FIGS. 18*a–c* show the case of an entirely transparent indication (white or silver color indication by the aluminum reflecting plates). Both FIGS. 19*a–c* and FIGS. 20*a–c* show the case of transparency-polarizing color mixed indication, in which FIGS. 19*a–c* show the polarizing color indication at the surrounding part of the puzzle indication surface and FIGS. 20*a–c* show the indication of a checkered pattern by transparency and polarizing color.

The above-mentioned color pattern at the completion of puzzle indication (FIGS. 17*a–c*–FIGS. 20*a–c*), the number of rows in lengthwise direction and in lateral direction (total number of puzzle elements), the ratio of two groups of polarizing plates 4, 5, namely, the ratio of 4X, 4Y and 5X, 5Y, etc. can be selected as desired when manufacturing puzzle toys, according to the requirement of the development of a game. Thus, the examples in this specification are given merely to explain the present invention and do not limit the purpose of the present invention.

In the above embodiment, first polarizing plates 4 have been provided only at the puzzle indication surface A but they can also be provided at the additional indication surface b. On the other hand, the puzzle indication surface A can have at a part thereof, for example, at the center, a transparent portion where first polarizing plates 4 do not exist. However, the limitation of polarizing color indication to the puzzle indication surface A by providing polarizing plates 4 only on that surface makes the puzzle elements 1 positioned at the additional indication surface b the same color, making the progress of a puzzle game more difficult and adding a magic element to the game, with the result that the appeal of puzzle toy according to the present invention may be enhanced.

If the transparent area at the upper surface of the case-housing 7 is limited to the portion corresponding to the puzzle indication surface A and the portion above the additional indication surface b is made opaque, a player is unable to observe puzzle elements 1 positioned at the additional indication surface b. This has the effect of making it more difficult to presuppose the development of a game.

The puzzle toy according to the present invention does not necessarily require arrangement of puzzle elements 1 in a flat state and/or checkered pattern. For example, in a puzzle toy of cylindrical shape or of a many-sided pillar shape, puzzle elements are made movable up and down and in circumferential direction (in this case, vertical direction or frontward and backward direction is made the first direction and the circumferential direction is made the second direction). In the case of the many-sided pillar shape, the second polarizing plate is made in a flat shape but in the case of the cylindrical shape, puzzle elements and second polarizing plates are made in the shape of a partial cylindrical piece and the first polarizing plate is bonded to the inner surface of the puzzle element. Referring to the moving direction of puzzle elements 1, in the embodiment the first direction and the second direction are made to meet at right angles with each other but it is not necessarily required that both directions meet at right angles with each other and the purpose of the present invention can be achieved even if both directions intersect each other at another chosen angle.

In the embodiment described, reflecting plates are provided for all puzzle elements 1 but if reflecting plates are provided at a part of puzzle elements or at a part of the puzzle indication surface and the additional indication surface, puzzle indication by the combination of three colors, namely, transparency indication, indication of the color of reflecting plate and the indication of polarizing color, can be obtained.

As stated above, in the present invention the color indication of puzzle elements is changed into the transparency indication and the polarizing color indication in relation to the direction of polarizing axis of the first polarizing plate with the moving of puzzle elements, by utilizing the double refraction polarization between the first polarizing plate fixed to the case and the second polarizing plate fixed to the puzzle element. Therefore, it is very difficult to presuppose the change of color indication of puzzle elements and to keep in mind the order of shifting puzzle elements up to the completion of the desired puzzle indication. Thus, interest in this puzzle toy is not lost even if it is used repeatedly for completing the puzzle indication.

What is claimed is:

1. In a puzzle toy in which puzzle indication is varied by shifting a plurality of puzzle elements arranged in plural rows in lengthwise direction and lateral direction, said puzzle toy including:

(a) a plurality of first polarizing plates fixed in a case in such a fashion that the direction of their respective polarizing axes are divided into a first group and a second group which meet at right angles with each other;

(b) second polarizing plates fixed to respective puzzle elements alignable with individual ones of said first polarizing plates, said second polarizing plates being so oriented that the direction of their respective polarizing axes are divided into a first group and the second group, the polarizing axis of said first group being disposed in the same direction as the polarizing axis of the first group of the first polarizing plates and the polarizing axis of said second group being disposed in the same direction as the polarizing axis of the second group of the first polarizing plates;

whereby the color indication of the puzzle elements is varied with the change of relative relation of polarizing axis of the second polarizing plates which move with each puzzle element and that of the first polarizing plate, fixed to the case, due to the transparency indicating action when polarizing axes of both polarizing plates are in parallel with each other and the polarizing color indicating action when polarizing axes of both polarizing plates are in the state of meeting at right angles with each other, on the basis of the principle of double refraction polarization between each aligned first polarizing plate and second polarizing plate.

2. In a puzzle toy in which puzzle indication is varied by shifting a plurality of puzzle elements arranged in plural rows in lengthwise direction and lateral direction, said puzzle toy including:

(a) a plurality of first polarizing plates fixed in a case in such a fashion that the direction of their respective polarizing axes are divided into the first group and the second group which meet at right angles with each other;

(b) second polarizing plates fixed to respective puzzle elements disposed under said first polarizing plates, said second polarizing plates being so oriented that the direction of their respective polarizing axes are divided into a first group and the second group, the polarizing axis of said first group being disposed in the same direction as the polarizing axis of the first group of the first polarizing plates and the polarizing axis of said second group being disposed in the same direction as the polarizing axis of the second group of the first polarizing plates;

(c) reflecting plates disposed under said second polarizing plates; whereby color indication of puzzle elements is effected by polarizing color indicating action while polarizing axes of both polarizing plates are in the state of meeting at right angles with each other and by reflecting plate color indicating action while polarizing axes of both polarizing plates are in parallel with each other, on the basis of the principle of double refraction polarization between each aligned first polarizing plate and second polarizing plate.

3. A puzzle toy as defined in claim 2, wherein the reflecting plates are made of aluminum so that color indication of puzzle elements at the transparency indicating action is made white or silver color to discriminate clearly from the polarizing color indication.

4. A puzzle toy as defined in claim 2, wherein a puzzle indication surface comprising the combination of color indication of many puzzle elements arranged in flat and checkered state is formed at the center part of the upper surface of said case in such a fashion that the puzzle indication surface at the upper plate of the case is made transparent and said first polarizing plates are fixed to the inner surface of the upper plate of the case corresponding to the puzzle indication surface, and a second polarizing plate and a reflecting plate are fixed to each puzzle element in such a fashion that the reflecting plate is under the second polarizing plate.

5. A puzzle toy comprising means forming a plane supporting surface, a plurality of puzzle elements supported on said surface, said elements being arranged on said surface in such a manner and in such number as to form a fitted-in equal-sided square, each of said elements comprising a polarizing plate attached to and supported on a reflecting plate, a transparent plate, means forming individual polarized plates in the form of an equal-sided square on a portion of the underside of said transparent plate, there being on each side of the square one less individual polarized plate than individual puzzle elements, means mounting said transparent plate and the individual polarized plates on the underside thereof above, parallel and adjacent the individual puzzle elements in such a manner that the individual polarized plates are always aligned with a like number of individual puzzle elements, and means transversely and laterally shifting said individual puzzle elements with respect to the individual polarized plates.

6. A puzzle toy according to claim 5, in which the polarized plates of the individual puzzle elements and the individual polarized plates on the underside of the transparent plate are individually polarized in such directions as to present a predetermined desired pattern when the individual puzzle elements are in a predetermined position relative to the individual polarized plates.

7. A puzzle toy according to claim 6 in which said shifting means comprises a plurality of transversely movable and a plurality of laterally movable U-shaped slides having upright sections respectively contacting each row of individual puzzle elements, in combination with a base supporting said slides for respective transverse and lateral movement, and means supporting said plane supporting surface means on said base above said slide.

8. A puzzle toy according to claim 7 in which said transparent plate is formed with slots in that portion thereof absent the polarized plates for receiving the upright sections of the movable slides, whereby the exposed ends of said upright sections are available to move the individual puzzle elements.

* * * * *